US006227098B1

(12) United States Patent
Mason

(10) Patent No.: US 6,227,098 B1
(45) Date of Patent: May 8, 2001

(54) RECOIL ATTENUATOR

(76) Inventor: James D. Mason, 6439 Caminito Listo, San Diego, CA (US) 92111

( * ) Notice: Subject to any disclaimer, the term of this patent is extended or adjusted under 35 U.S.C. 154(b) by 0 days.

(21) Appl. No.: 09/237,500

(22) Filed: Jan. 25, 1999

Related U.S. Application Data

(63) Continuation-in-part of application No. 09/136,992, filed on Aug. 20, 1998, now abandoned.

(51) Int. Cl.[7] ..... F41A 3/90
(52) U.S. Cl. ..... 89/193; 89/43.01
(58) Field of Search ..... 89/191.01, 191.02, 89/193, 156, 43.01, 43.02

(56) References Cited

U.S. PATENT DOCUMENTS 2,393,627 * 1/1946 Garand ..... 89/193
2,679,192 * 5/1954 Seeley et al. ..... 89/42.01
3,656,400 * 4/1972 Stoner et al. ..... 89/193
3,779,131 * 12/1973 Kawamura ..... 89/191.02
5,123,194 * 6/1992 Mason ..... 89/191.01

FOREIGN PATENT DOCUMENTS

714566 * 12/1941 (DE) ..... 89/193
56071 * 4/1939 (DK) ..... 89/191.01

OTHER PUBLICATIONS

English tranlation of Danish patent No. 56,071.*

* cited by examiner

*Primary Examiner*—Stephen M. Johnson
(74) *Attorney, Agent, or Firm*—Brown, Martin, Haller & McClain LLP

(57) ABSTRACT

A recoil-attenuating system for a gun having a barrel and breech assembly slidably mounted on a supporting carriage, the system using combustion gases at an early stage in the firing action to drive a piston in a cylinder which in turn is connected to a fluid-damped attenuator connected between the barrel and the supporting structure. The system allows a considerable reduction in weight of the entire gun structure.

11 Claims, 5 Drawing Sheets

RECOIL ATTENUATOR

CROSS-REFERENCES TO RELATED APPLICATIONS

This patent application is a continuation-in-part of application Ser. No. 09/136,992 filed Aug. 20, 1998, now abandoned.

BACKGROUND OF THE INVENTION

Many different methods have been used to reduce recoil in a gun. In artillery or cannon-type weapons the barrel is usually mounted to slide on a carriage and the recoil is absorbed by springs, fluid shock absorbers and the like, sometimes in combination with a muzzle mounted blast deflector. Recoil forces drive the gun mechanism to the rear in reaction to the projected being driven forward by the propellant gases. Since the gun mechanism is much heavier than the projectile, the major portion of the recoil is absorbed by accelerating the mass of the gun. Making a gun heavier has been one method of absorbing recoil but this results in a gun which is difficult to handle and transport, particularly when heavy weapons must be moved by aircraft.

It would be of great benefit to be able to effectively reduce recoil in a relatively light weight gun such as an artillery piece.

SUMMARY OF THE INVENTION

The recoil-controlling system of the present invention allows the gun weight, particularly that of the moving components, to be greatly reduced. Accordingly, the weight of the supporting gun carriage can also be reduced.

The moving or sliding portion of the gun, specifically the barrel and breech assembly, is coupled to an attenuator unit which is connected between the barrel and the supporting frame or carriage. The barrel has a bleed-off port just ahead of the projectile in its loaded position, so that propellant gases exit through the port before the projectile has progressed very far down the barrel. The gases are diverted into a reaction cylinder to drive a plunger or a piston, the cylinder being connected to an attenuator which is a fluid-damped shock absorber. The attenuation occurs early in the firing cycle near the momentum-to-acceleration conversion point-.This early attenuation avoids the heavy kinetic energy forces as the projectile continues along the barrel and exits the muzzle. The great reduction in recoil allows the weight of the barrel and its supporting carriage to be reduced.

The system is not limited to artillery pieces but can also be adapted to .50 caliber, 20 mm, 40 mm and similar smaller caliber weapons.

BRIEF DESCRIPTION OF THE DRAWINGS

Further advantages will be apparent in the following detailed description and the accompanying drawings, in which.

DESCRIPTION OF THE PREFERRED EMBODIMENT

Figure 1:
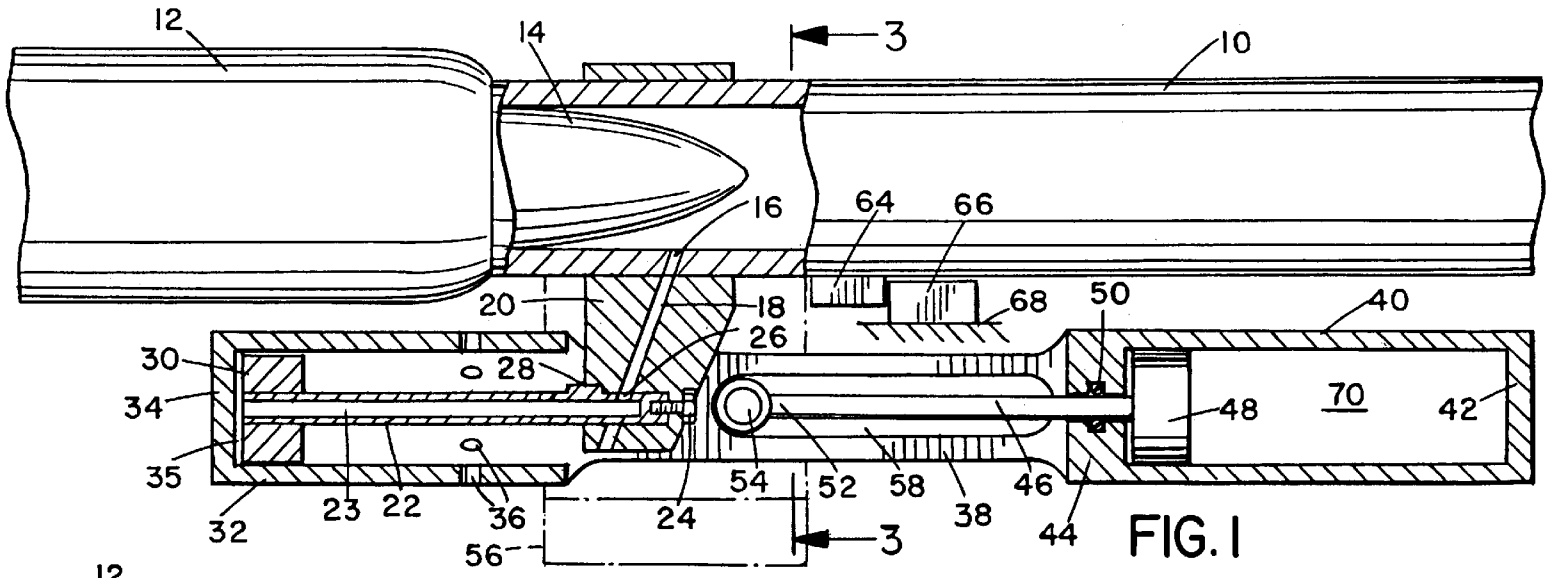
FIG. 1 is a side view, with portions cut away, of a typical barrel and the associated attenuator assembly.
Figure 2:
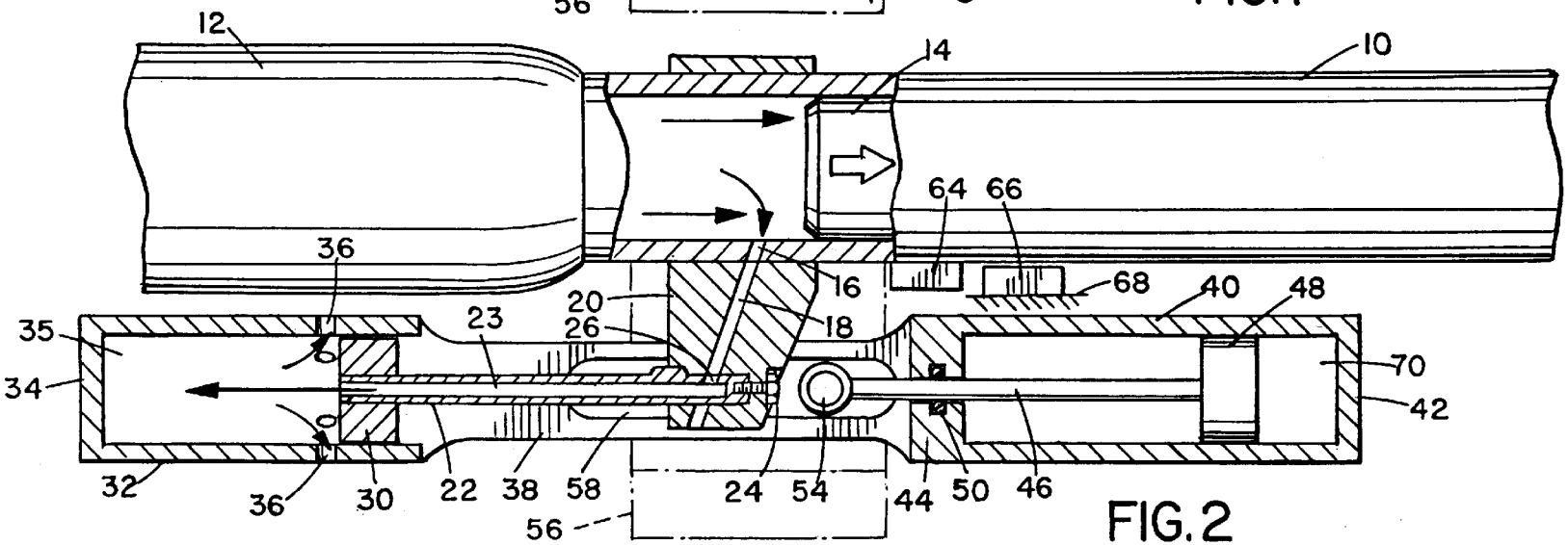
FIG. 2 is a similar view, but showing the firing action.

The structure shown in FIGS. 1–4 is configured particularly for an artillery piece of a variety of calibers. The structure includes a barrel 10 attached to a breech 12, which may be of any conventional type. A projectile 14 is shown loaded in the breech 12 with the tip protruding just into the barrel. Just forward of the breech, the side wall of the barrel has a gas port 16 which connects with a passage 18 in a support block 20. The support block 20 is secured to and extends downwardly from the barrel 10. At the lower end of the support block is a rearwardly projecting hollow piston rod 22 which can be retained by a screw 24, or the like. The piston rod 22 has an inlet port 26 aligned with the passage 18 and has a rotation preventing key 28 to maintain alignment of the port and passage.

On the rear end of piston rod 22 is a piston 30 through which the hollow piston rod projects. The piston is enclosed in a reaction cylinder 32 having a closed rear end 34. In the rest position the piston is at the rear end of the cylinder, as in FIG. 1. In the fired position of FIG. 2, the piston is at the forward end of the cylinder, the cylinder wall having vent ports 36, which are now behind the piston to exhaust the combustion gases.

Extending forwardly from the reaction cylinder 32 are spaced frame rails 38 which pass closely on opposite sides of the support block 20. Fixed to the forward ends of frame rails 38 is an attenuator cylinder 40 coaxial with reaction cylinder 32. The forward end 42 of cylinder 40 is closed and the rear end 44 supports a piston rod 46 connected to a piston 48 sliding in the attenuator cylinder. An O-ring 50 in the end 44 provides a fluid seal around the piston rod. The rear end 52 of piston rod 46 is secured to a load carrying cross pin 54, which is secured at both ends in a trunnion block 56 attached to the barrel. The trunnion block is indicated in broken line since the structure can vary considerably. Frame rails 38 have longitudinal slots 58 through which the cross pin 54 passes, so that the frame rails slide on the cross pin.

Figures 3, 4, 5, 6, 7:
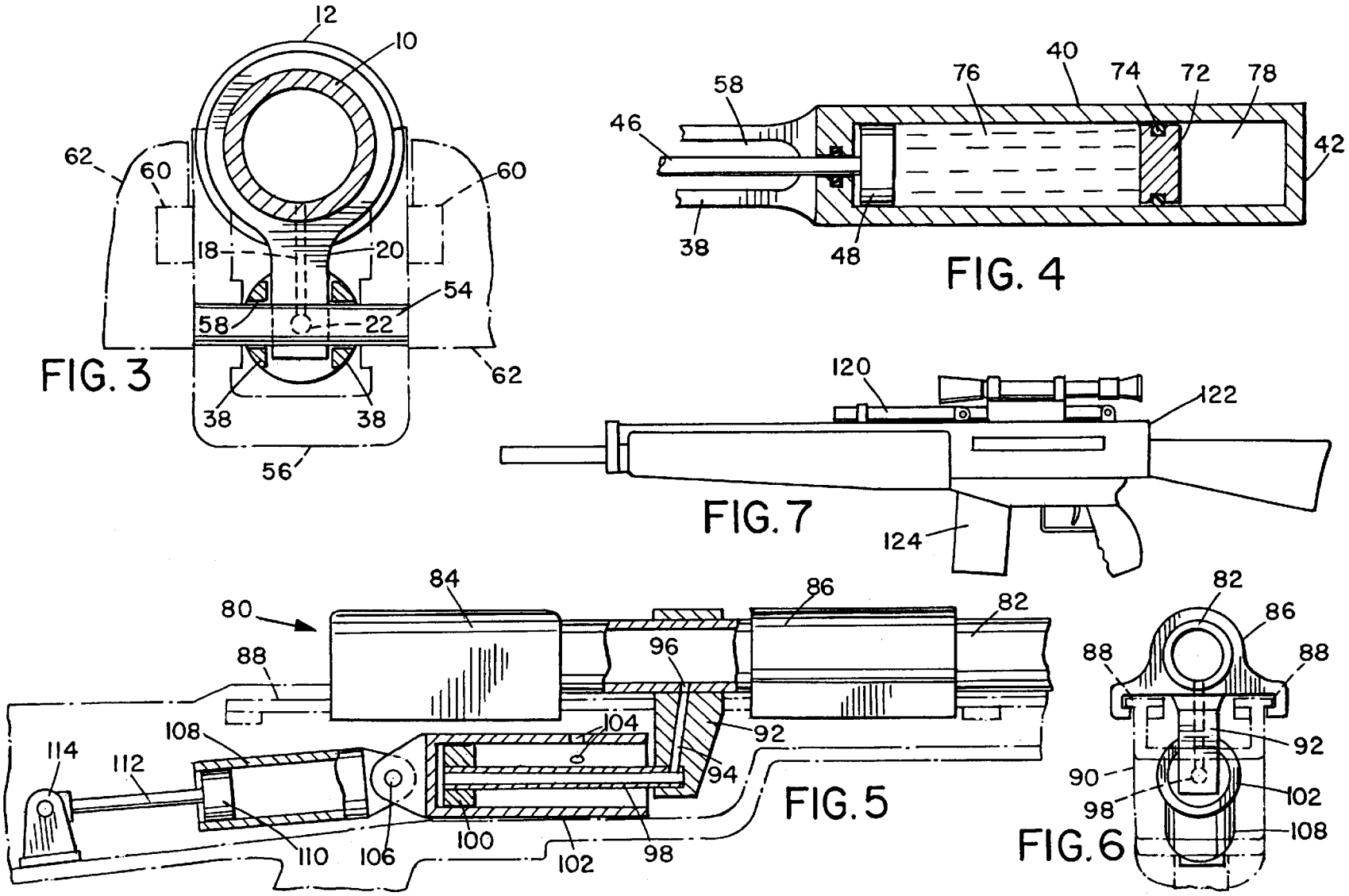
FIG. 3 is a sectional view taken on line 3—3 of FIG. 1, with supporting structure indicated in broken line.
FIG. 4 is a sectional view of the attenuator similar to a portion of FIG. 1, showing an alternative floating piston configuration.
FIG. 5 is a side view, with portions cut away, showing the mechanism adapted to a .50 caliber, or similar type gun.
FIG. 6 is a front view of the structure of FIG. 5.
FIG. 7 is a side view showing the attenuator in an above barrel configuration.

The mounting of the barrel on the gun carriage can also vary considerably, so a typical arrangement is shown in broken line in FIG. 3, in which the trunnion block 56 has longitudinal rails 60 which slide in suitable tracks in the gun carriage 62. The barrel and breech assembly is thus slidable on the gun carriage and the attenuator mechanism is independently slidable relative to the barrel. The barrel has a forward stop 64 which seats against a battery stop 66 fixed at a suitable position on the gun frame 68 to hold the mechanism in the battery.

In operation, the system is at rest, as in FIG. 1. When the gun is fired the projectile is accelerated forward in the barrel by the combustion gases. As the projectile passes the gas port 16, as in FIG. 2, a portion of the gas exits through the port 16 and passage 18, through the hollow piston rod 22 into the rear chamber 35 of reaction cylinder 32. This drives the reaction cylinder rearward and, through the coupling to the attenuator cylinder 40, pulls that cylinder to the rear. This causes piston 48 to compress the air or other gas in the chamber 70, so that the recoil is progressively attenuated as the projectile continues through the barrel.

At the end of the stroke the gases escape through the vent ports 36. Springs or other such means, not shown, can be used to return the gun to battery after firing.

By starting the action at the beginning of the firing cycle, the hard propellant gases at their peak pressure cause the maximum reaction before the kinetic energy forces build up as the projectile progresses through the barrel. The recoil is held to a very short stroke and the peak recoil is rapidly dissipated. The energy absorbed by the attenuator is dissipated as the attenuator cylinder recovers and the gun returns to battery.

An alternative attenuator cylinder is illustrated in FIG. 4, in which the structure is the same as that described, except that a free-floating piston 72 with an O-ring 74 is installed in the cylinder. This divides the cylinder into two chambers 76 and 78, with oil or other liquid in the rear chamber 76 and cushioning air or other gas in the front chamber 78.

The system thus far described is a push-pull configuration, with the reaction and attenuator elements on opposite sides of the connection to the barrel. However, both elements can be on the same side of the barrel connection in a push-push relation, as in FIGS. 5 and 6.

In this configuration, the system is shown adapted to a large caliber rifle 80, such as a .50 caliber sniper rifle. The barrel 82 with breech 84 is secured in a trunnion block 86 which slide on rails 88 on a supporting frame 90, shown in broken line. A support block 92 is secured on the barrel 82, with a passage 94 communicating from the barrel gas port 96 to a rearwardly extending hollow piston rod 98. The piston rod 98 carries a piston 100 which is contained in a reaction cylinder 102. The reaction cylinder has gas vent ports 104 near the forward end to vent the gases at the end of the firing stroke.

The reaction cylinder is coupled by a hinged connection 106 to an attenuator cylinder 108 containing a piston 110. A piston rod 112 extends from piston 110 to a pivotal attachment 114 on the frame or butt structure of the gun. The pivotal connections show alignment of the elements within the conventional configuration of the hand-held weapon. The action is similar to that previously described, with the propellant gases driving the reaction cylinder 102 to the rear, which action is attenuated in the attenuator cylinder 108. This allows a considerable reduction in weight of the weapon, which can be an advantage to a sniper who has to carry and set up the weapon.

A further configuration is illustrated in FIG. 7, in which an attenuator system 120 is mounted on top of a rifle type weapon 122. This is particularly convenient when the rifle has a large capacity magazine 124 on the underside.

Figure 8:
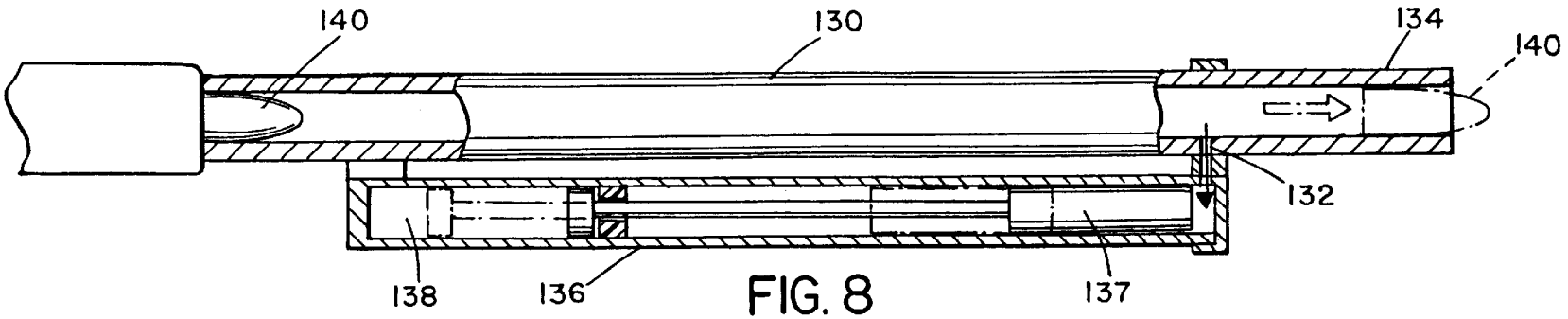
FIG. 8 PRIOR ART
FIG. 8 is a side view, with portions cut away, of a prior art recoil reaction system.
Figure 9:
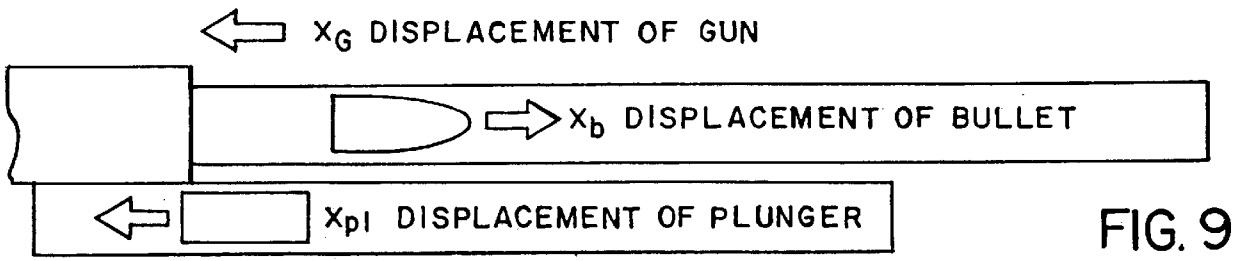
FIG. 9 is a diagram of the forces involved in the firing action.

In the typical prior art system shown in FIG. 8, the barrel 130 has a vent 132 near the muzzle end 134. Gases from the barrel are fed to a recoil cylinder 136 to drive a piston 137 rearwardly into a cushion chamber 138 as indicated in broken line. In this configuration the bullet 140 has almost left the barrel and most of the recoil force has already occurred before any reaction takes place. Thus the compensation for recoil is negligible.

The effectiveness of the present system can be calculated by the following equations, in which:

| | |
|---|---|
| $m_G$ | mass of gun minus mass of plunger |
| $m_{pl}$ | mass of plunger |
| $m_b$ | mass of bullet |
| $x_G$ | displacement of gun |
| $x_{pl}$ | displacement of plunger |
| $x_b$ | displacement of bullet |
| $dx_G/dt$ | velocity of gun |
| $dx_{pl}/dt = v_{pl}$ | velocity of plunger |
| $dx_b/dt$ | velocity of bullet |
| $dx_{GO}/dt$ | velocity of gun at end of phase I |
| $d^2x_G/dt^2$ | acceleration of gun |
| $d^2x_{pl}/dt^2$ | acceleration of plunger |
| $d^2x_b/dt^2$ | acceleration of bullet |
| $c_{pl}$ | linear damping constant for plunger |
| $P(t)$ | Chamber pressure |
| $P_{avg}$ | Average chamber pressure |
| $A_{pl}$ | Area of plunger |
| $A_b$ | Area of bullet or chamber |
| $a = c_{pl}/m_{pl}$ | |
| $t^*$ | Time interval for phase I |
| T | Time at end of phase II |

The action occurs in two phases. Phase I is the time interval during which the bullet is travelling from its initial position to the point at which the gases begin to flow into the recoil device, i.e., $0 \leqq t \leqq t^*$. On the basis that the pressure in the barrel rises almost instantaneously to a level of approximately 45 ksi the force exerted on the bullet, temporarily neglecting rifling, is $45000(\pi(1/4)^2)$lbf=8840 lbf. For a 700 grain bullet the acceleration is $$a=(8840/[(0.1)32.2(12)]\text{in/sec}^2=3.41\times10^7\ \text{in/sec}^2$$

Assuming the vent into the recoil device is located approximately an inch from the beginning of the barrel the time required for the gas to begin to flow into the recoil device is $$t^*=\sqrt{2(1)/3.41e7}\ \text{sec}=0.24\ \text{millisec}$$

The corresponding velocity of the bullet is $v=at^*=682$ ft/sec at which time the recoil velocity of the gun is 4.3 ft/sec.

Phase II is the time interval during which the recoil device is active. This is the time interval from $t^*$ to T, where T is the time when the plunger (piston) of the recoil device reaches the position where the gas is vented to the outside, as in FIG. 2. It should be noted that the term plunger is used to denote the piston, for clarity in the equation terminology. The time T must be determined from the equations of motion:

$$P(t)A_b=m_b d^2x_b dt^2 \quad \text{(eq1)}$$

Figure 10:
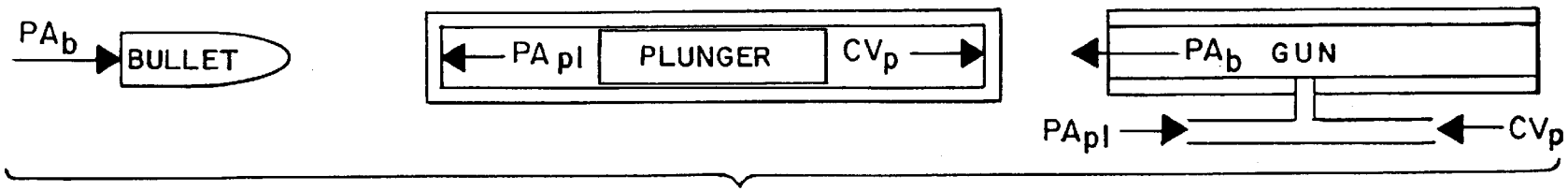
FIG. 10 illustrates diagramatically the forces defined in the equations.

The basic forces in the firing action are shown in FIG. 10. During this phase, the bullet, plunger and the rest of the weapon are considered as separate masses for the following analysis which is applicable to a typical .50 caliber rifle as an example.

The equation of motion for the plunger is:

$$c_{pl}v_{pl}-P(t)A_{pl}=m_{pl}d^2x_{pl}/dt^2 \quad \text{(eq2)}$$

The equation of motion for the gun is:

$$-c_{pl}v_{pl}+P(t)(A_{pl}-A_b)=m_G d^2x_G/dt^2 \quad \text{(eq3)}$$

where we have assumed the following:

a) The barrel pressure is felt instantaneously in the recoil device.

b) Attenuation on right side of plunger is linear.

c) Acceleration of fluid in attenuator can be neglected.

With $v_{pl}=dx_{pl}/dt$, (eq2) can be written as $$d^2x_{pl}/dt^2-(c_{pl}/m_{pl})dx_{pl}/dt=-P(t)A_{pl}/m_{pl}$$

or upon integration, $$dx_{pl}/dt-(c_{pl}/m_{pl})x_{pl}=-\int_{t*}^{t}(P(\tau)A_{pl}/m_{pl})d\tau=-Q(t)$$

where the constant of integration is zero on the basis of the initial conditions. With $a=c_{pl}/m_{pl}$ the solution of the differential equation is $$x_{pl}=c_1\exp(at)-\int_{t*}^{t}Q(\tau)\exp(t-\tau))d\tau$$

when $t=t^*x_{pl}=0$ so that $c_1=0$.

At this point we will further assume that an average pressure of $P_{avg}=35$ ksi acts in the barrel and recoil device during the remainder of the motion. In this case:

$$Q(t)=(P_{avg})(A_{pl}/m_{pl})(t-t^*)$$

and $$x_{pl}=-(P_{avg})(A_{pl}/m_{pl})\int_{t*}^{t}(\tau-t*)\exp(a(t-\tau))d\tau$$

When y=−L, the distance the plunger moves before the gas is vented to the outside, t=T resulting in $$(Lm_{pl})/(P_{avg}A_{pl})=\int_{t*}^{t}(\tau-t*)\exp(a(T-\tau))d\tau$$

to be solved for T. Taking L as 6 in and c=10 lbf/(in/sec), T can be determined as approximately 1.2 millisec. For L=6 in and c=1 lbf/(in/sec), T can be determined as approximately 2.2 millisec. Returning to (eq3) and assuming that $A_{pl}\approx A_b$ it follows that $$m_Gd^2x_G/dt^2=-c_pN_{pl}=c_{pl}(P_{avg}A_{pl})/(a\ m_{pl})[\exp(a(t-t^*))-1]$$

Integrating and satisfying the initial condition gives $$m_G(dx_G/dt-dx_{GO}/dt)=c_{pl}(P_{avg}A_{pl})/(a^2m_{pl})[\exp(a(t-t^*))-a(t-t^*)]$$

so that when t=T the velocity of the body of the gun is given by $$dx_G/dt=dx_{GO}/dt+c_{pl}(P_{avg}A_{pl})/(a^2m_Gm_{pl})[\exp(a(T-t^*))-a(T-t^*)]$$

which can be calculated to be $$dx(t)_G/dt\approx+12\text{ ft/sec}$$

i.e., in a forward direction.

This illustrates effectiveness of the system by not only overcoming recoil of discharge, but actually generating a forward moment to the gun mass. This vector can be reduced to zero or neutral recoil by adjusting parameters of the system such as gas port location and diameter, piston diameter or cylinder stroke distance.

Figure 11:
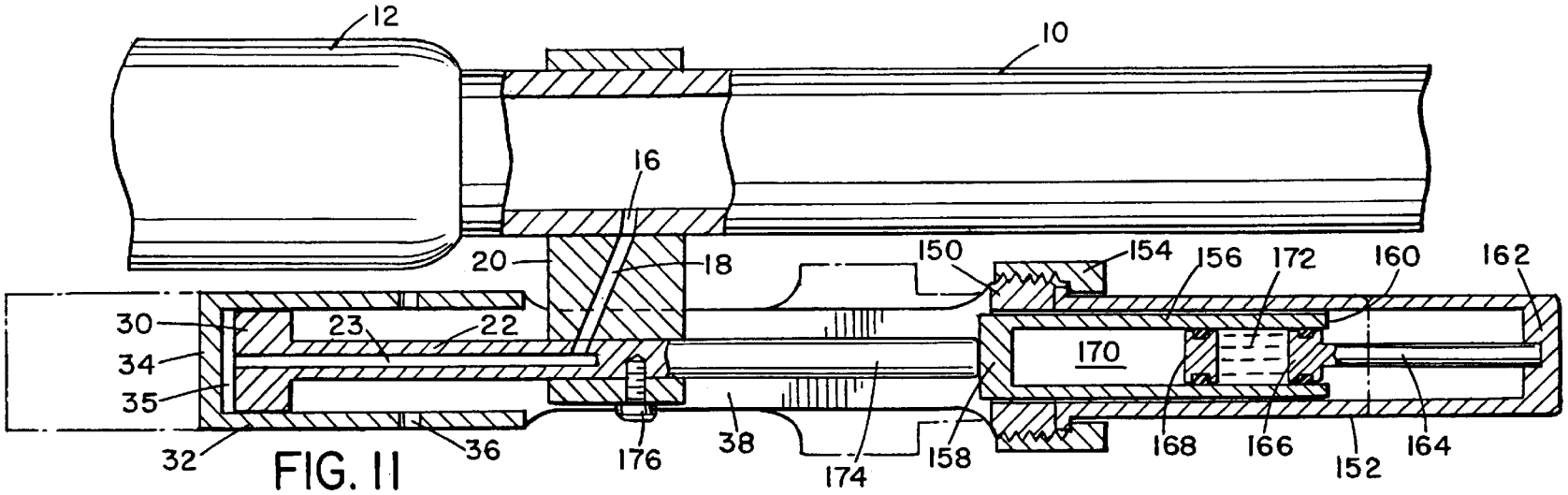
FIG. 11 is a view similar to FIG. 1, showing an alternative structure for connecting the reaction cylinder and the attenuator cylinder.
Figure 12B:
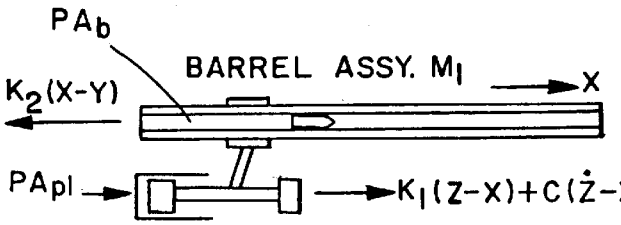
FIGS. 12A–12D illustrate diagrammatically the individual elements defined in the related equations.
Figure 12D:
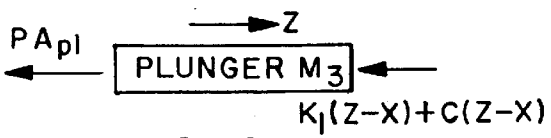
Figure 12A:
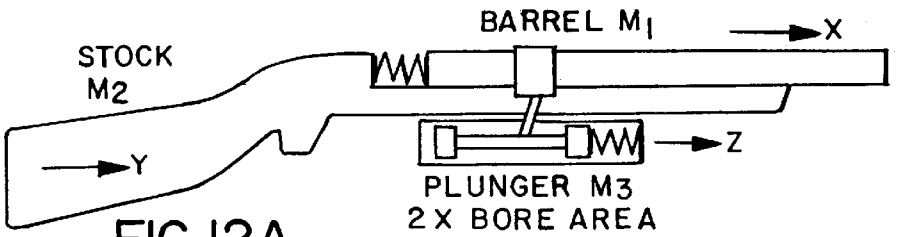
Figure 12C:
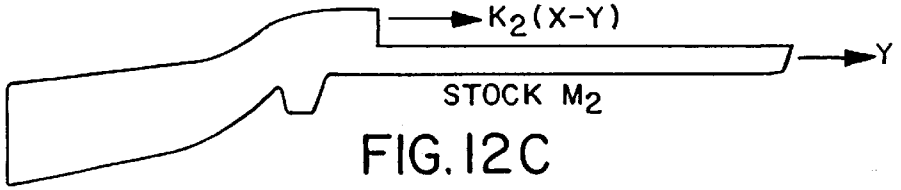

A further configuration shown in in FIG. 11 is similar in many features to the structure of FIG. 1, but the attenuator arrangement is changed and the frame rails do not slide on a cross pin.

At the forward end of frame rails 38 is an externally threaded hub 150 to which an attenuator cylinder 152 is secured in coaxial alignment by a threaded collar 154. An inner cylinder 156 is slidably mounted through hub 150 and into cylinder 152, the inner cylinder having a closed rear end 158 and an open forward end 160. The forward end 162 of cylinder 152 is closed and extending rearwardly from the closed end is a piston rod 164 on the rear end of which is a piston 166, which is slidable inside the inner cylinder 156. In the inner cylinder 156 is a floating piston 168 which divides the inner cylinder into an air chamber 170 and a fluid filled chamber 172. The configuration and function are similar to that described for FIG. 4.

Piston rod 22 has an integral forwardly extending push rod 174, which bears against the closed rear end of inner cylinder 156. The push rod 174 is secured in the support block 20 by a locking screw 176.

When the gun is fired the high pressure gases drive the reaction cylinder 32 rearwardly, as previously described, also pulling the attenuator cylinder 152 to the rear. However, the push rod 174 prevents the inner cylinder 156 from moving. Rearward motion of cylinder 152 drives piston 166 into the inner cylinder 156, providing the desired attenuation of the load.

This configuration requires a somewhat different analysis of the Phase 2 sequence. For this phase the barrel, stock and plunger are considered as separate masses, as illustrated in FIG. 12.

The attenuating effect is calculated by the following equations, in which:

| | |
|---|---|
| $m_1$ | mass of barrel |
| $m_2$ | mass of stock |
| $m_3$ | mass of plunger |
| x | displacement of barrel |
| y | displacement of stock |
| z | displacement of plunger |
| dx/dt | velocity of barrel |
| dy/dt | velocity of stock |
| dz/dt | velocity of plunger |
| $\ddot{x}$ | acceleration of barrel |
| $\ddot{y}$ | acceleration of stock |
| $\ddot{z}$ | acceleration of plunger |
| c | linear damping coefficient shock absorber |
| $k_1$ | spring constant for shock absorber |
| $k_2$ | spring constant for barrel support |
| P(t) | Chamber and recoil device pressure |
| $A_{pl}$ | Area of plunger |
| $A_b$ | Area of bullet or chamber |
| $t^*$ | Time interval for phase I |
| T | Time at end of phase II |

With x as the displacement of the gun, y as the displacement of the stock and z as the displacement of the plunger o recoil device the equations of motion are $$m_1\ddot{x}=c(\dot{z}-\dot{x})+k_1(z-x)+p(A_{pl}-A_b)-k_2(x-y)$$

$$m_2\ddot{y}=k_2(x-y)$$

$$m_3\ddot{z}=-pA_{pl}-k_1(z-x)-c(\dot{z}-\dot{x})$$

or in matrix notation $$m\ddot{x}+c\dot{x}+kx=f$$

where $$m = \begin{bmatrix} m_1 & 0 & 0 \\ 0 & m_2 & 0 \\ 0 & 0 & m_3 \end{bmatrix}, \quad c = \begin{bmatrix} c & 0 & -c \\ 0 & 0 & 0 \\ -c & 0 & c \end{bmatrix},$$

$$k = \begin{bmatrix} k_1 + k_2 & -k_2 & -k_1 \\ -k_2 & k_2 & 0 \\ -k_1 & 0 & k_1 \end{bmatrix}, \quad f = \begin{bmatrix} pA_{pl} - pA_b \\ 0 \\ -pA_{pl} \end{bmatrix} \ \& \ x = \begin{bmatrix} x \\ y \\ z \end{bmatrix}$$

These are to be integrated subject to the initial conditions $$x(0)=0 \ \& \ \dot{x}(0)=\sqrt{0}$$

Figure 13:
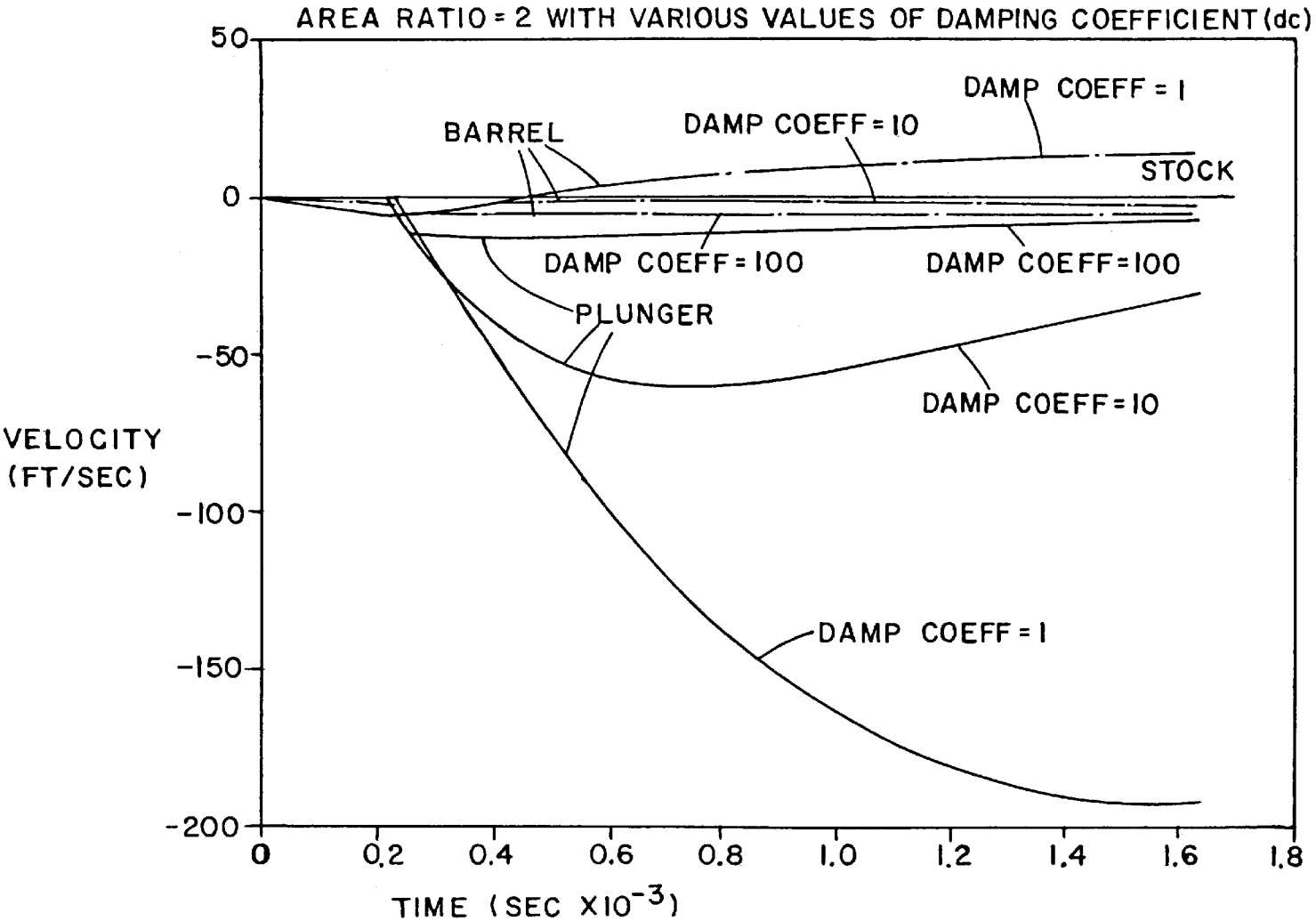
FIG. 13 is a graph of the damping effects.

The main parameters effecting the results are 1) the area ratio of the plunger namely, $A_{pl}/A_b$, and 2) the value of the damping coefficient c. A standard central difference algorithm is to be used to carry out the integration. The results are shown in FIG. 13.

Since the recoil attenuator system is adaptable to a variety of gun types, the associated support and mounting structure can vary widely. It should be understood that the position and size of the gas ports can be tuned to suit a particular gun. In guns which use recoil or gas action to automatically load a successive round, it will be necessary to allow for this in controlling the degree of attenuation.

It should be noted that if ports 36 are omitted, the trapped gases will return to flush the bore as the attenuator assembly returns to the starting position. Either mode can be used at the discretion of the designer.

The system eliminates the need for a muzzle brake, which usually causes a high blast effect and much discomfort and distraction for the firing crew. However, this design allows for the installation of an effective flash suppressor, which reduces detection when firing.

Although a preferred embodiment of the invention has been described above by way of example only, it will be understood by those skilled in the field that modifications may be made to the disclosed embodiment without departing from the scope of the invention, which is defined by the appended claims.

I claim:

1. In a gun having a supporting frame on a barrel and breech assembly mounted on the frame for sliding motion substantially parallel to the axis of the barrel, the improvement comprising:

the barrel and breech assembly including a barrel and a breech integral with the barrel at a near end thereof;

a recoil attenuator coupled between said barrel and said frame, said attenuator having a gas driven movable element for producing a reaction force opposed to that of a projectile in the barrel, including a reaction cylinder having closed end and a reaction piston slidable therein, defining a chamber between the piston and the closed end, the piston being coupled to said barrel;

a fluid damped attenuator cylinder coupled to said reaction cylinder, an attenuator piston slidably mounted in said attenuator cylinder, the cylinder having a closed end defining a fluid cushioning chamber between the closed end and the piston;

the attenuator piston being connected to said supporting frame;

means for extracting combustion gases from said barrel adjacent the breech; and means for directing the gases to said reaction cylinder between the piston and cylinder.

2. The structure of claim 1 wherein said means for extracting combustion gases includes a support block secured to a rear portion of said barrel closely adjacent to said breech;

said means for extracting combustion gases including a gas extraction port through said barrel adjacent the breech and a gas conducting passage through said support block from said port;

said attenuator being connected to said support block to receive the gases from said passage to said reaction cylinder.

3. The structure of claim 2 wherein said reaction piston has a piston rod mounted in said support block and having an axial bore communicating from said gas conducting passage to said chamber.

4. The structure of claim 2, wherein said reaction cylinder extends rearwardly of said support block;

said attenuating cylinder being forward of said support block; and a rigid frame connecting said reaction cylinder to said attenuator cylinder.

5. The structure of claim 4, wherein said rigid frame includes a pair of frame rails extending on opposite sides of said support block.

6. The structure of claim 5, wherein said attenuator piston has a rearwardly extending piston rod connected to said supporting frame.

7. The structure of claim 6, wherein said piston rod has a transverse cross pin fixed thereto, said cross pin being secured to the supporting frame.

8. The structure of claim 7, wherein said frame rails have longitudinal slots through which said cross pin passes.

9. The structure of claim 1 wherein said attenuator cylinder has a free floating piston between said attenuator piston and the closed end, defining a liquid containing chamber and a gas containing damping chamber on opposite sides of the free floating piston.

10. The structure of claim 1 and including a pivotal connection between said reaction cylinder and said attenuator cylinder.

11. The structure of claim 1, wherein the recoil attenuator is mounted below the barrel and breech assembly.

* * * * *